US008188656B2

(12) United States Patent
Sugiyama et al.

(10) Patent No.: US 8,188,656 B2
(45) Date of Patent: May 29, 2012

(54) PHOTOMULTIPLIER TUBE

(75) Inventors: Hiroyuki Sugiyama, Hamamatsu (JP); Hideki Shimoi, Hamamatsu (JP); Tsuyoshi Kodama, Hamamatsu (JP); Hitoshi Kishita, Hamamatsu (JP); Yasuyuki Kohno, Hamamatsu (JP); Keisuke Inoue, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 126 days.

(21) Appl. No.: 12/710,714

(22) Filed: Feb. 23, 2010

(65) Prior Publication Data

US 2010/0213838 A1 Aug. 26, 2010

(30) Foreign Application Priority Data

Feb. 25, 2009 (JP) ..... P2009-042391

(51) Int. Cl.
*H01J 43/20* (2006.01)

(52) U.S. Cl. ..... 313/534

(58) Field of Classification Search ..... 313/532–534; 250/207

See application file for complete search history.

(56) References Cited

U.S. PATENT DOCUMENTS

| | | | | |
|---|---|---|---|---|
| 5,264,693 | A | 11/1993 | Shimabukuro et al. | |
| 5,329,110 | A * | 7/1994 | Shimabukuro et al. | 250/207 |
| 5,568,013 | A | 10/1996 | Then et al. | |
| 7,049,747 | B1 | 5/2006 | Goodberlet et al. | |
| 7,294,954 | B2 | 11/2007 | Syms | |
| 2004/0089860 | A1 * | 5/2004 | Edamura et al. | 257/10 |
| 2009/0224666 | A1 | 9/2009 | Kyushima et al. | |

* cited by examiner

*Primary Examiner* — Peter Macchiarolo
(74) *Attorney, Agent, or Firm* — Drinker Biddle & Reath LLP

(57) ABSTRACT

A photomultiplier tube including a casing having a glass substrate with a main surface made with an insulating material, dynodes having a $1^{st}$ stage to an $N^{th}$ stage which are arrayed to be spaced away sequentially from a first end side to a second end side on the main surface, a photocathode installed on the first end side to be spaced away from the $1^{st}$ stage dynode to emit photoelectrons, and an anode part installed on the second end side to be spaced away from the $N^{th}$ stage dynode, wherein a groove is formed between two adjacent dynodes on the main surface of the glass substrate, and the $1^{st}$ stage to the $N^{th}$ stage dynodes are fixed on raised parts adjacent to the grooves.

11 Claims, 9 Drawing Sheets

PHOTOMULTIPLIER TUBE

BACKGROUND OF THE INVENTION

1. Field of the Invention

The present invention relates to a photomultiplier tube for detecting incident light from outside, 2. Related Background Art Conventionally, compact photomultiplier tubes by using of fine processing technology have been developed. For example, a flat surface-type photomultiplier tube which is arranged with a photocathode, dynodes and an anode on a translucent insulating substrate is known (refer to Patent Document 1 given below). The above-described structure makes it possible to detect weak light at a high degree of reliability and also to downsize a device.

Patent Document 1: U.S. Pat. No. 5,264,693

SUMMARY OF THE INVENTION

However, in the above-described conventional photomultiplier tubes, there is a tendency that multiplied electrons are easily made incident on the surface of an insulating substrate installed between each adjacent stage of the dynodes. Therefore, it is possible that the insulating substrate is electrically charged that results in a decreased withstand voltage.

Therefore, the present invention has been made in view of the above problem, and an object of which is to provide a photomultiplier tube capable of preventing electrons from being made incident onto an insulation part between dynodes to improve a withstand voltage.

In order to solve the above problem, the photomultiplier tube of the present invention is a photomultiplier tube which is provided with a casing having a substrate on which a flat surface made with an insulating material is formed, an electron multiplying part having a $1^{st}$ stage to an $N^{th}$ stage (N denotes an integer of 2 or more) which are arrayed so as to be spaced away sequentially from a first end side to a second end side on the flat surface of the substrate, a photocathode which is installed on the first end side so as to be spaced away from the electron multiplying part, converting incident light from outside to photoelectrons to emit the photoelectrons, an anode part which is installed on the second end side so as to be spaced away from the electron multiplying part, taking out electrons multiplied by the electron multiplying part as a signal, in which a groove, the surface of which is made with an insulating material, is formed between two adjacent stages of the electron multiplying part on the flat surface of the substrate, and the electron multiplying part constituted with the $1^{st}$ stage to the $N^{th}$ stage is fixed on raised parts adjacent to the grooves on the substrate.

According to the above-described photomultiplier tube, incident light is made incident onto the photocathode and converted to photoelectrons, and the photoelectrons are made incident onto the electron multiplying part constituted with a plurality of stages on the substrate and multiplied accordingly, and the thus multiplied electrons are outputted as an electric signal from the anode part. In this instance, an insulative groove is formed on the surface of the substrate between adjacent stages of the electron multiplying part, thus making it possible to prevent electrons passing between adjacent stages of the electron multiplying part from being made incident onto the surface of the substrate. It is, thereby, possible to prevent a decrease in withstand voltage that results from electric charge on the surface of the substrate.

It is preferable that the groove is formed over a range held between the edge part of a $K-1^{th}$ stage electron multiplying part on the second end side and the edge part of a $K^{th}$ stage (K denotes an integer of 2 or more but N or less) electron multiplying part on the first end side. In this instance, the orbit of electrons between adjacent stages of the electron multiplying part can be reliably separated from the surface of the substrate, thus making it possible to effectively prevent electrons from being made incident onto the surface of the substrate.

It is also preferable that the groove is formed so as to reach to the second end side more than the edge part of the $K^{th}$ stage electron multiplying part on the first end side. According to the above-described constitution, electrons passing between adjacent stages of the electron multiplying part are made incident onto the second end side of the groove to a lesser extent, thus making it possible to reduce electrons of being incident onto the surface of the substrate.

Further, it is preferable that the groove is formed so as to reach to the first end side more than the edge part of the $K-1^{th}$ stage electron multiplying part on the second end side. In this instance, electrons passing through adjacent stages of the electron multiplying part are made incident onto the first end side of the groove to a lesser extent, thus making it possible to reduce electrons of being incident onto the surface of the substrate.

Still further, it is preferable that a groove which communicatively connects between adjacent grooves at the end parts of the raised parts is also formed on the flat surface of the substrate. Thereby, the electron multiplying part on the raised parts is separated from the substrate to further improve a withstand voltage.

DESCRIPTION OF THE PREFERRED EMBODIMENTS

Figure 1:
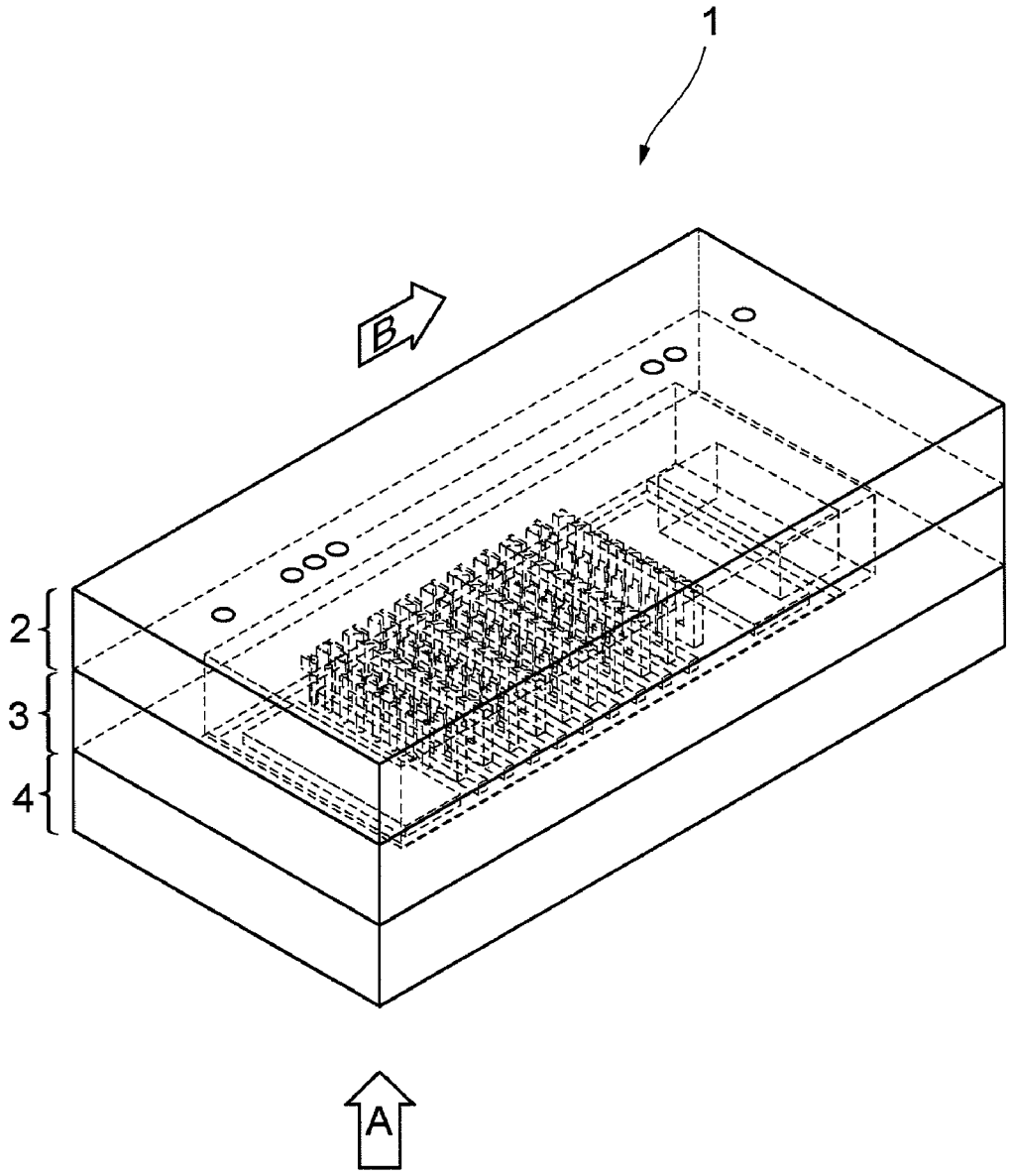
FIG. 1 is a perspective view of a photomultiplier tube according to one preferred embodiment of the present invention.

Hereinafter, a detailed description will be given for preferred embodiments of the photomultiplier tube related to the present invention by referring to drawings. In addition, in describing the drawings, the same or corresponding parts will be given the same reference numerals to avoid cumulative description.

Figure 2:
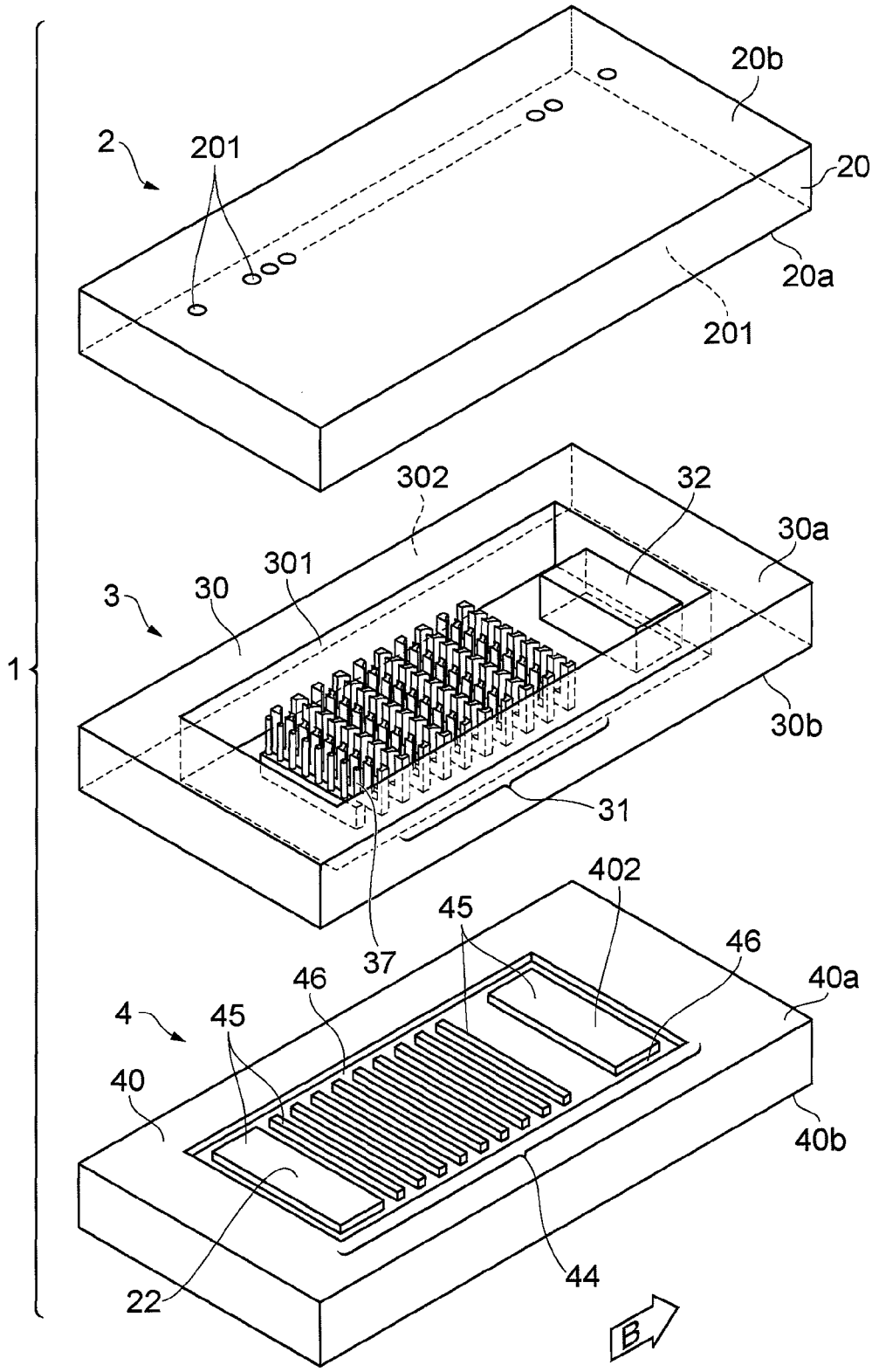
FIG. 2 is an exploded perspective view of the photomultiplier tube shown in FIG. 1.

FIG. 1 is a perspective view of a photomultiplier tube 1 related to one preferred embodiment of the present invention. FIG. 2 is an exploded perspective view of the photomultiplier tube 1 in FIG. 1.

The photomultiplier tube 1 shown in FIG. 1 is a photomultiplier tube having a transmission-type photocathode and provided with a casing having an upper frame 2 (glass substrate), a side-wall frame 3 (silicon substrate) and a lower frame 4 (glass substrate). The photomultiplier tube 1 is an electron tube such that a light incident direction onto the photocathode intersects with a direction at which electrons are multiplied at the electron multiplying part. Specifically, when light is made incident from a direction indicated by the arrow A in FIG. 1, photoelectrons emitted from the photocathode are made incident onto the electron multiplying part, thereby secondary electrons are subject to cascade amplification in a direction indicated by the arrow B to take out a signal from the anode part.

In addition, in the following description, the upstream side of an electron multiplying channel (the side of the photocathode) along a direction at which electrons are multiplied is described as "a first end side," while the downstream side (the side of the anode part) is described as "a second end side." Further, a detailed description will be given for individual constituents of the photomultiplier tube 1.

As shown in FIG. 2, the upper frame 2 has a rectangular flat-plate like glass substrate 20 as a base material. A plurality of conductive terminals 201, which penetrate between a main surface 20*a* thereof and a surface 20*b* opposing the main surface 20*a* to be electrically connected to a photocathode 22 that is described later, focusing electrodes 37, an electron multiplying part 31 and an anode part 32, supplying power from outside and outputting a signal, are installed on the glass substrate 20. In addition, in FIG. 1 and FIG. 2, the conductive terminals 201 are described by omitting some of them for simplifying the drawings. Further, the upper frame 2 is not limited to a glass substrate having the conductive terminals 201 but may include a plate-like member made with laminated ceramic with a built-in circuit structure for supplying power from outside and outputting a signal. In addition, where the photocathode 22 is equal in potential to the focusing electrodes 37, common conductive terminals may be used.

The side-wall frame 3 is constituted with a rectangular flat-plate like silicon substrate 30 as a base material. A penetration part 301 enclosed with a frame-like side wall part 302 is formed from a main surface 30*a* of the silicon substrate 30 to a surface 30*b* opposing thereto. The penetration part 301 is provided with a rectangular opening and an outer periphery of which is formed so as to run along the outer periphery of the silicon substrate 30.

Inside the penetration part 301, the focusing electrodes 37, the electron multiplying part 31 and the anode part 32 are formed from the first end side to the second end side. These focusing electrodes 37, the electron multiplying part 31 and the anode part 32 are formed by processing the silicon substrate 30 according to reactive ion etching (RIE) or other processing methods, with silicon used as a main raw material. The focusing electrodes 37 are electrodes for guiding photoelectrons emitted from the photocathode 22 that is later described into the electron multiplying part 31 and installed between the photocathode 22 and the electron multiplying part 31. The electron multiplying part 31 includes N stages (N denotes an integer of two or more) of dynodes (electron multiplying parts) set different in potential from the photocathode 22 to the anode part 32 along a direction at which electrons are multiplied and provided with a plurality of electron multiplying channels at each stage. The anode part 32 is positioned so as to hold the electron multiplying part 31 together with the photocathode 22. The electron multiplying part 31 and the anode part 32 are individually connected to the lower frame 4 by anode bonding, diffusion joining or joining using a sealing material such as a low-melting-point metal (for example, indium), by which they are arranged on the lower frame 4 two-dimensionally (the details will be described later). In addition, inside the penetration part 301, columnar parts (not illustrated) which electrically connect the photocathode 22 with conductive terminals 201 for the photocathode 22 are also formed similarly. Further, the electron multiplying part 31 and the focusing electrodes 37 are also individually connected to the corresponding conductive terminals 201 and set in a predetermined potential via the conductive terminals 201. For example, where dynodes are made of ten stages, a voltage of 100 to 1000V is applied in incremental steps at every 100V intervals to the photocathode 22 at the dynodes, and a voltage of 1100V is applied to the photocathode 22 at the anode part 32.

The lower frame 4 includes a rectangular flat-plate like glass substrate 40 as a base material. The glass substrate 40 forms a main surface 40*a* (flat surface) with glass which is an insulating material. The photocathode 22, which is a transmission-type photocathode, is formed at a site opposing the penetration part 301 of the side-wall frame 3 on the main surface 40*a* (a site other than a region joining with the side wall part 302) and at the end part opposite to the anode part 32.

Further, in a range on the main surface 40*a* where the photocathode 22, the focusing electrodes 37, the electron multiplying part 31 and the anode part 32 are fixed, a plurality of linear grooves 44 are formed along a direction intersecting with a direction at which a plurality of stages of dynodes are arrayed (a direction at which electrons are multiplied and a direction indicated by the arrow B in FIG. 2). These grooves 44 are provided between the side wall part 302 and the photocathode 22, between the photocathode 22 and the focusing electrodes 37, between the focusing electrodes 37 and the electron multiplying part 31, between individual stages of dynodes at the electron multiplying part 31, between the electron multiplying part 31 and the anode part 32, and between the anode part 32 and the side wall part 302, when the photocathode 22, the focusing electrodes 37, the electron multiplying part 31, and the anode part 32 are fixed on the main surface 40*a*. These grooves 44 form raised parts 45 which act as parts of fixing the photocathode 22, the focusing electrodes 37, the electron multiplying part 31 and the anode part 32 to the main surface 40*a*. Further, two grooves 46 for allowing the end parts of adjacent grooves 44 to communicatively connect are formed along a direction at which electrons are multiplied at the end parts of the raised parts 45 in a direction perpendicular to a direction at which electrons are multiplied. Due to the above-described grooves 44, 46, each of the raised parts 45 is spaced away by the grooves and also spaced away via the grooves from the side wall part 302. In the present embodiment, the grooves 44 provided between the side wall part 302 and the photocathode 22 and between the anode part 32 and the side wall part 302, and two grooves 46, are provided so as to run along an inner wall surface (surface on the vacuum side) of the side wall 302.

Figure 3:
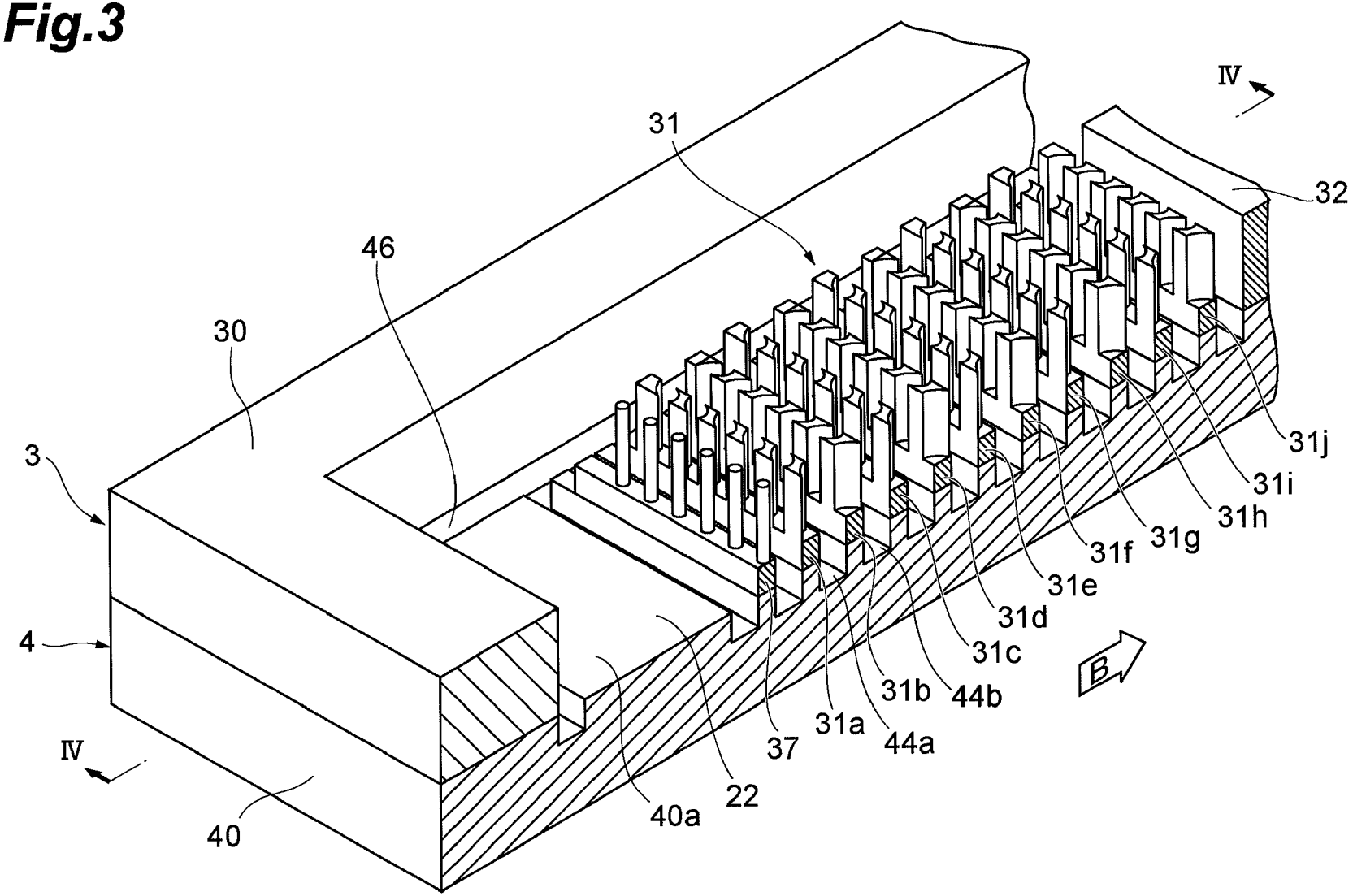
FIG. 3 is a partially broken perspective view showing an internal structure of the photomultiplier tube in FIG. 1.
Figure 4:
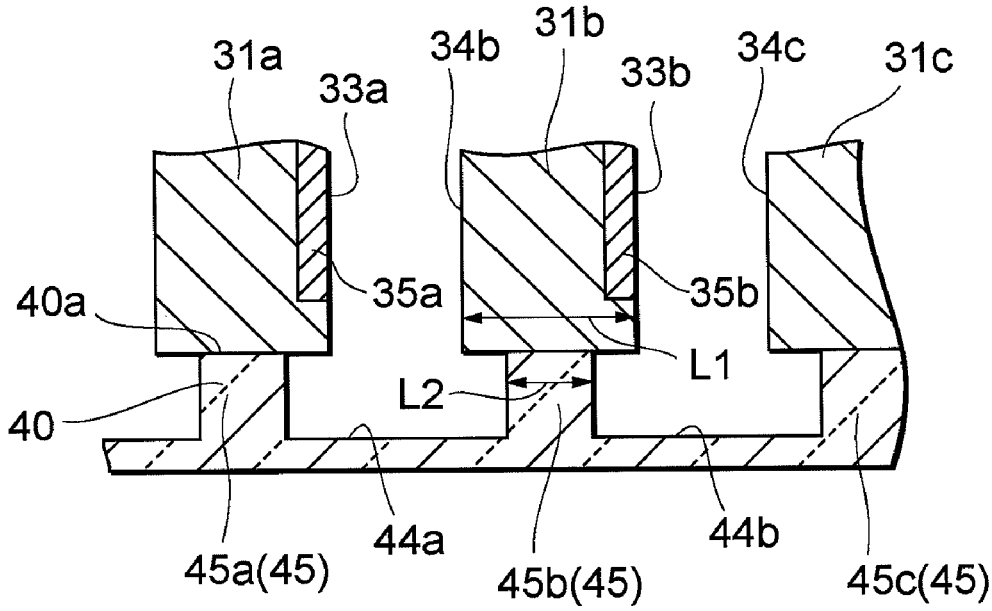
FIG. 4 is a partially enlarged sectional view along the line IV to IV of an electron multiplying part and a lower frame in FIG. 3.

Then, the internal structure of the photomultiplier tube 1 will be described in more detail by referring to FIG. 3 and FIG. 4. FIG. 3 is a partially broken perspective view showing the internal structure of the photomultiplier tube 1. FIG. 4 is a partially enlarged sectional view of the electron multiplying part 31 and the lower frame 4 along the line IV to IV in FIG. 3.

As shown in FIG. 3, the electron multiplying part 31 has a plurality of stages of dynodes arrayed so as to be spaced away sequentially from the first end side to the second end side on the main surface 40*a* (in a direction indicated by the arrow B). The number of stages of dynodes is not limited to a specific number of stages, and FIG. 3 shows a case where the electron multiplying part includes a $1^{st}$ stage dynode to a $10^{th}$ stage dynode corresponding to the reference numerals 31*a* to 31*j*.

The photocathode 22 is installed so as to be spaced away from the $1^{st}$ stage dynode 31*a* to the first end side on the main surface 40*a* behind the focusing electrode 37, and the photocathode 22 is formed on the main surface 40*a* of the glass substrate 40 as a transmission-type photocathode. When incident light transmitted from outside through the glass substrate 40, which is the lower frame 4, arrives at the photocathode 22, photoelectrons corresponding to the incident light are emitted and the photoelectrons are guided into the electron multiplying part 31 by the focusing electrodes 37.

The anode part 32 is installed so as to be spaced away from the $10^{th}$ stage dynode 31*j* to the second end side on the main surface 40*a*, and the anode part 32 is an electrode for outputting electrons which are multiplied by the electron multiplying part 31 in a direction indicated by the arrow B as an electric signal.

FIG. 4 is a partially enlarged sectional view along the line IV to IV of the electron multiplying part and the lower frame in FIG. 3 and a section view of the glass substrate 40 in the thickness direction along a direction at which electrons are multiplied. As shown in FIG. 4, the $1^{st}$ stage dynode 31*a* and the $2^{nd}$ stage dynode 31*b* are fixed on the main surface 40*a*, with a space kept from each other, and on surfaces acting as the respective electron multiplying channels of the dynodes 31*a*, 31*b*, secondary electron surfaces 35*a*, 35*b* are formed by alkali activation after deposition of aluminum (Al) and antimony (Sb). Then, a linear groove 44*a* is formed between two adjacent stages of dynodes 31*a*, 31*b* on the main surface 40*a* along a direction orthogonal to a direction indicated by the arrow B. The groove 44*a* is formed by applying mechanical processing such as sandblasting to the glass substrate 40 and, therefore, provided with a surface formed with glass, that is, an insulating material. In this instance, the groove 44*a* may be formed by chemical processing such as wet etching with hydrogen fluoride or other suitable reactants or dry etching.

Further, the $3^{rd}$ stage dynode 31*c* is spaced away from the $2^{nd}$ stage dynode 31*b* to the second end side and fixed on the main surface 40*a*, and a linear groove 44*b* is formed between these two stages of dynodes 31*b*, 31*c* on the main surface 40*a* along a direction which is the same as that of the groove 44*a*. In a similar manner, the $4^{th}$ stage dynode 31*d* to the $10^{th}$ stage dynode 31*j* are spaced away sequentially behind the plurality of grooves 44 and fixed on the main surface 40*a*.

Due to the presence of the grooves 44*a*, 44*b*, the $1^{st}$ stage dynode 31*a* to the $3^{rd}$ stage dynode 31*c* are joined on the raised parts 45*a* to 45*c* respectively adjacent to the grooves 44*a*, 44*b* and extending linearly along a direction at which the grooves 44*a*, 44*b* extend. In a similar manner, the $4^{th}$ stage dynode 31*d* to the $10^{th}$ stage dynode 31*j* are joined on the raised parts 45 adjacent to the plurality of grooves 44. Joining surfaces of the raised parts 45 with the dynodes are flat surfaces and can be joined stably with the bottoms of the dynodes which are flat surfaces.

In this instance, the groove 44*a* is formed so as to go beyond a range held between the edge part 33*a* of the main surface 40*a* of the $1^{st}$ stage dynode 31*a* on the second end side and the edge part 34*b* of the main surface 40*a* of the $2^{nd}$ stage dynode on the first end side. In other words, the groove 44*a* is formed so as to spread to the second end side of the main surface 40*a* more than the edge part 34*b* of the $2^{nd}$ stage dynode 31*b* and also formed so as to spread to the first end side of the main surface 40*a* more than the edge part 33*a* of the $1^{st}$ stage dynode 31*a*, with the bottom formed in a flat surface shape. Further, the groove 44*b* is also formed so as to go beyond a range held between the edge part 33*b* of the main surface 40*a* of the $2^{nd}$ stage dynode 31*b* on the second end side and the edge part 34*c* of the main surface 40*a* of the $3^{rd}$ stage dynode 31*c* on the first end side. In a similar manner, all the grooves 44 held between the dynodes 31*c* to 31*j* are formed so as to go beyond a range held between two edge parts of dynodes 31*c* to 31*j*.

Since the grooves are structured as described above, the width L1 of a joining surface of the dynodes 31*a* to 31*j* along a direction at which each of them is arrayed on the main surface 40*a* (a direction along the arrow B in FIG. 3) is set greater than the width L2 of a joining surface of the raised parts 45 in the same direction on the main surface 40*a*. In addition, in the present embodiment, the raised parts and the dynodes are arranged so as to be in alignment with each other with respect to the center in the width direction. However, they may deviate to the first end side or the second end side.

Figure 5:
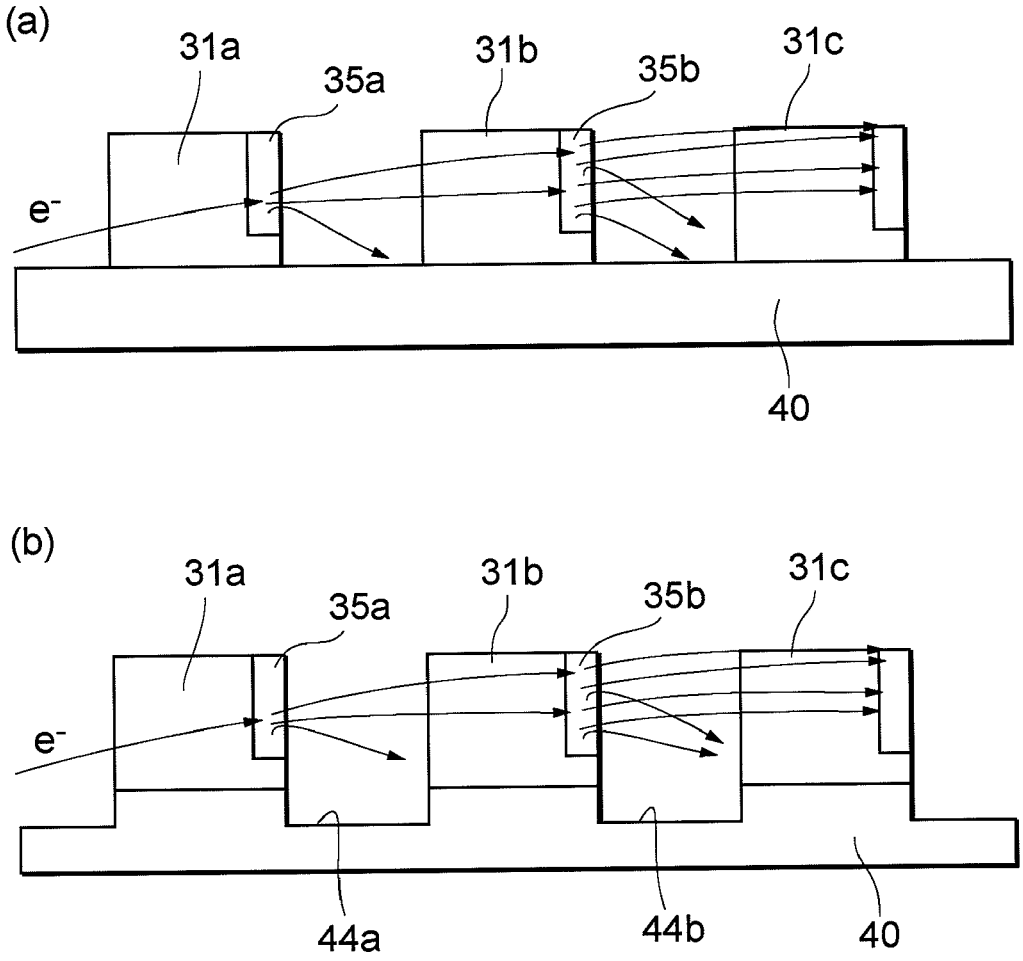
FIG. 5 are side views showing orbits of electrons at the electron multiplying part in FIG. 3.

According to the so-far described photomultiplier tube 1, incident light is made incident onto the photocathode 22 and thereby converted to photoelectrons. Then, the photoelectrons are made incident onto the electron multiplying part 31 having a plurality of stages on the glass substrate 40 and multiplied accordingly and the thus multiplied electrons are outputted as an electric signal from the anode part 32. In this instance, the insulating groove 44 is formed between adjacent stages of the electron multiplying part 31 on the main surface 40*a* of the glass substrate 40. Therefore, the glass substrate 40 is kept away from secondary electron surfaces of the dynodes, thus making it possible to prevent electrons passing between the dynodes of the electron multiplying part 31 from being made incident onto the main surface 40*a*. For example, where the dynodes 31*a*, 31*b*, 31*c* are joined on the glass substrate 40 having a flat surface (FIG. 5(*a*)), the orbit of electrons passing between the dynodes comes closer to the glass substrate 40 and the electrons are more easily made incident onto the glass substrate 40. In contrast, where the glass substrate 40 has the grooves 44*a*, 44*b* between the dynodes 31*a*, 31*b*, 31*c* (FIG. 5(*b*)), the orbit of electrons passing between the dynodes can be kept away from the glass substrate 40. It is thereby possible to prevent a decrease in withstand voltage due to electric charge on the glass substrate 40 and also to realize reduction of noise resulting from emission of light from the glass substrate 40 and improvement in voltage hysteresis and light hysteresis characteristics. Further, if the glass substrate 40 is electrically charged by multiplied electrons, a greater distance between a charged region and the dynodes makes it possible to prevent a decrease of the withstand voltage.

Figure 6:
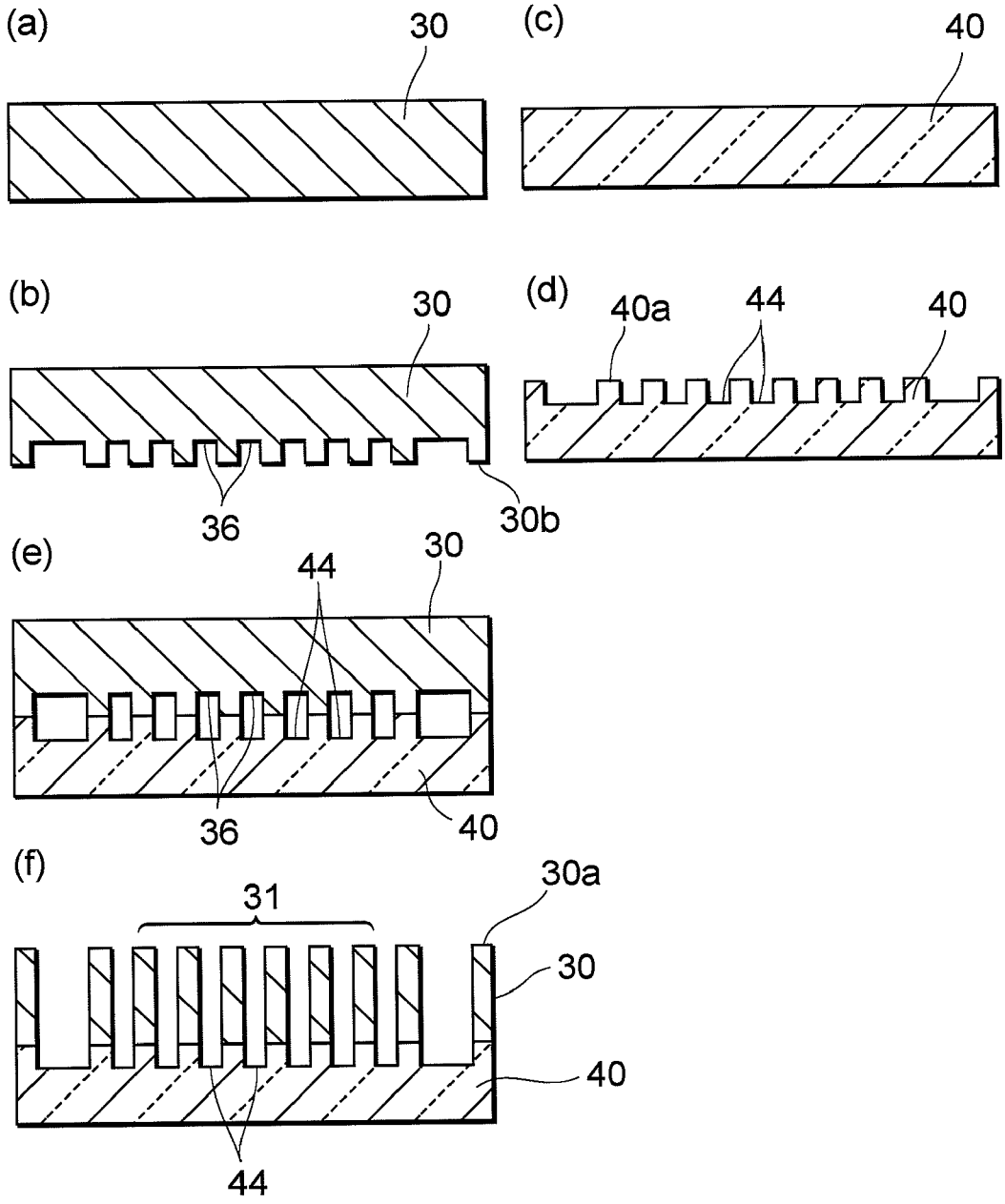
FIG. 6 are sectional views for explaining a method for processing the electron multiplying part in FIG. 3.

Further, the photomultiplier tube 1 has an advantage of improving the productivity in processing the electron multiplying part 31. FIG. 6 is a conceptual view for explaining a method for processing the electron multiplying part 31 in the photomultiplier tube 1. First, a removed part 36 corresponding to a void part between each stage of the dynodes is formed on the surface 30*b* of the silicon substrate 30 by a DEEP-RIE (deep reactive ion etching) process or the like (FIG. 6(*a*) and FIG. 6(*b*)), and in parallel therewith, the grooves 44 are formed on the main surface 40*a* of the glass substrate 40 (FIG. 6(*c*) and FIG. 6(*d*)). The removed part 36 is, for example, formed so as to provide 150 μm in a distance between adjacent stages of dynodes, and each of the grooves 44 is formed so as to provide 150 μm in depth. In addition, in this instance, the groove 44 is formed by sandblasting. However, the grooves 44 may be provided by forming raised parts projecting from a flat surface so as to be spaced away from each other. Thereafter, the surface 30*b* of the silicon substrate 30 and the main surface 40*a* of the glass substrate 40 are joined by anode joining, with the removed parts 36 overlapped on the grooves 44 (FIG. 6(*e*)). Then, the main surface 30*a* of the silicon substrate 30 is subject to a DEEP-RIE process, by which each stage of dynodes is formed, for example, to be 800 μm in height (FIG. 6(*f*).

As described above, after formation of the dynodes on the glass substrate 40, Al and Sb are deposited on them and thereafter they are subjected to alkali activation to form secondary electron surfaces. In this instance, the presence of the grooves 44 makes it possible to prevent adjacent dynodes from being electrically connected due to attachment of materials constituting secondary electron surfaces such as Al and Sb (conductive materials) on the glass substrate 40. On the other hand, where there are no grooves 44, in order to prevent a decrease of the withstand voltage between individual stages of dynodes due to attachment of conductive materials, care must be taken not to attach conductive materials between these stages of dynodes by using a mask such as SUS. Therefore, the photomultiplier tube 1 of the present embodiment eliminates such a necessity that uses the mask, thereby improving the production efficiency to a great extent.

Further, the grooves 44 can be provided between the photocathode 22 and the focusing electrode 37 and between the anode part 32 and the side wall part 302, thus making it possible to improve a withstand voltage between individual structures. Still further, the groove 46 for allowing the end part of each groove 44 to communicatively connect is provided, by which each of the raised parts 45 is completely spaced away by the groove 46 to improve the withstand voltage between individual structures. In addition, on development of stray electrons which are deviated from an electron multiplying channel, it is possible to prevent the electrons from being made incident onto the substrate 40 and also suppress external influences via the side wall part 302. The necessity for using a mask such as SUS is also eliminated, thereby preventing conductive materials from attachment between individual structures at the time of production.

The present invention shall not be limited to the above-described embodiments. For example, a range of the groove 44*a* formed on the glass substrate 40 may be such that is held between the edge part 33*a* of the $1^{st}$ stage dynode 31*a* and the edge part 34*b* of the $2^{nd}$ stage dynode 31*b*.

Figure 7:
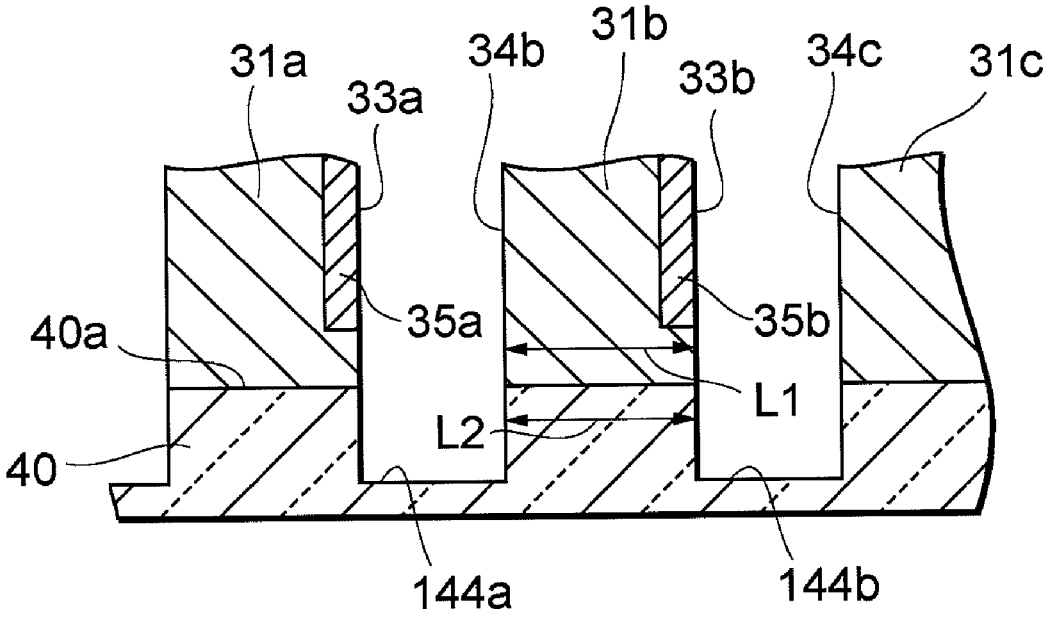
FIG. 7 is a partially enlarged sectional view showing a modified example of the electron multiplying part and the lower frame in FIG. 3.
Figure 8:
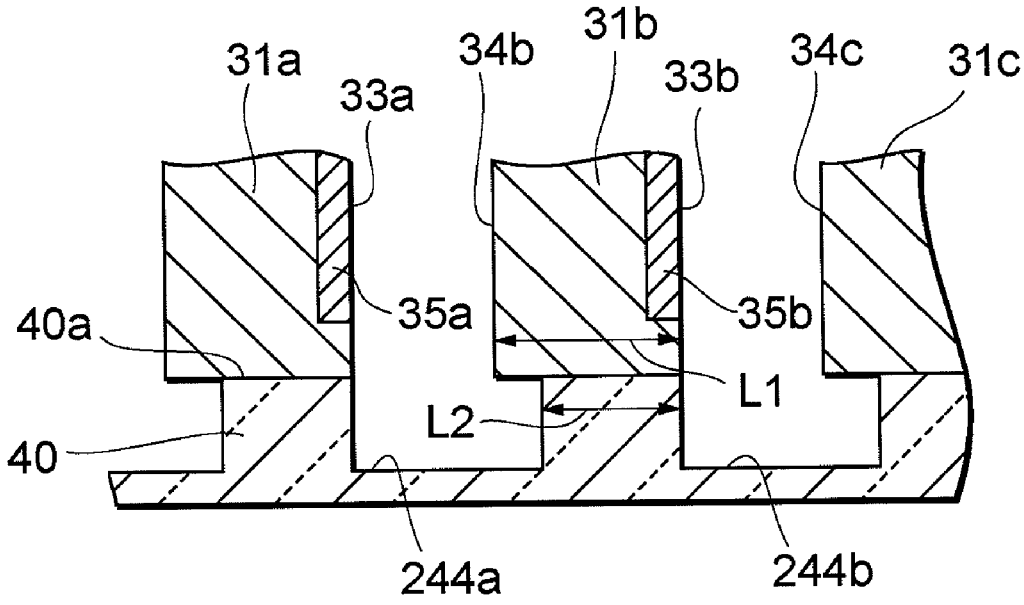
FIG. 8 is a partially enlarged sectional view showing a modified example of the electron multiplying part and the lower frame shown in FIG. 3.
Figure 9:
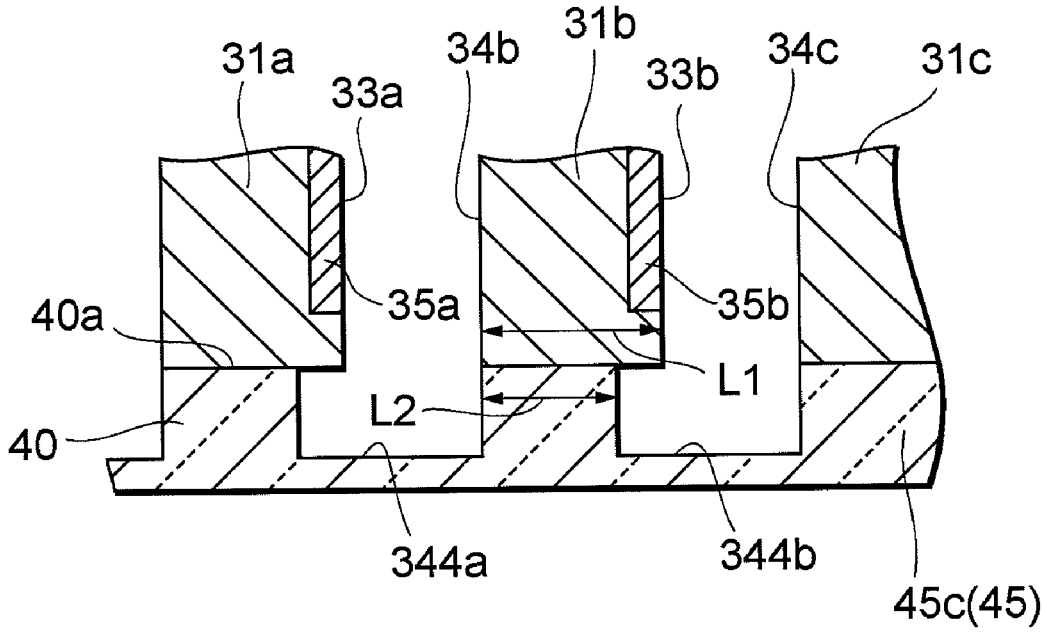
FIG. 9 is a partially enlarged sectional view showing a modified example of the electron multiplying part and the lower frame in FIG. 3.

As shown in FIG. 7, for example, a range at which the groove 144*a* is formed may be in agreement with a range from the edge part 33*a* of the dynode 31*a* to the edge part 34*b* of the dynode 31*b*. Further, as shown in FIG. 8, the edge part of the groove 244*a* on the first end side is in alignment with the edge part 33*a* of the dynode 31*a* and only that on the second end side may be formed so as to spread from the edge part 34*b* of the dynode 31*b*. As shown in FIG. 9, the edge part of the groove 344*a* on the second end side is in alignment with the edge part 34*b* of the dynode 31*b* and only that on the first end side may be formed so as to spread from the edge part 33*a* of the dynode 31*a*. In that the orbit of multiplied electrons is separated from the surface of the glass substrate 40, as shown in FIG. 8, it is preferable to spread the second end side of the groove 244*a* opposing a direction at which electrons are multiplied more than the edge part of the dynode. It is more preferable to spread the both ends of the groove 44*a* more than the edge parts of the adjacent dynodes, as shown in FIG. 4.

In the present embodiment, the photocathode 22 is a transmission-type photocathode but may include a reflection-type photocathode. Further, the anode 32 may be arranged between the dynode 31*i* and the dynode 31*j*.

The invention claimed is:

1. A photomultiplier tube comprising:

a casing having a substrate which has insulating properties, the substrate having a first end and a second end opposite to the first end;

an electron multiplying part including a $1^{st}$ to an $N^{th}$ stage (N denotes an integer of 2 or more) which are arrayed to be spaced away sequentially from the first end to the second end on the flat surface of the substrate, the electron multiplying part configured to multiply electrons in a direction from the first end to the second end;

a photocathode installed at the first end spaced away from the electron multiplying part, converting incident light to emit the photoelectrons; and an anode part installed at the second end spaced away from the electron multiplying part;

wherein grooves are formed in the substrate, each groove located between two adjacent stages of the electron multiplying part on the flat surface of the substrate, and the electron multiplying part is fixed on raised parts adjacent to the grooves on the substrate.

2. The photomultiplier tube according to claim 1, wherein widths of the raised parts are narrower than widths of the stages of the electron multiplying part in the direction measured from the first end to the second end.

3. The photomultiplier tube according to claim 2, wherein a rear sidewall of a stage overhangs over a groove located in the rear of the stage.

4. The photomultiplier tube according to claim 2, wherein a front sidewall of a stage overhangs over a groove located in the front of the stage.

5. The photomultiplier tube according to claim 1, the substrate further comprising a second groove which communicatively connects between the adjacent grooves at the end parts of the raised parts, located on the flat surface of the substrate and arranged in the direction from the first end to the second end.

6. The photomultiplier tube according to claim 1, wherein the grooves form an exposed surface of the substrate, each groove located between two adjacent stages of the electron multiplying part.

7. The photomultiplier tube according to claim 3, wherein a front sidewall of the stage is flush with a side wall of the groove located in front of the stage.

8. The photomultiplier tube according to claim 4, wherein a rear sidewall of the stage is flush with a side wall of the groove located in the rear of the stage.

9. The photomultiplier tube according to claim 1, wherein the grooves form an exposed surface of the substrate, each groove located between two adjacent stages of the electron multiplying part, and a rear sidewall of a stage overhangs over a groove located in the rear of the stage.

10. The photomultiplier tube according to claim 1, wherein the grooves form an exposed surface of the substrate, each groove located between two adjacent stages of the electron multiplying part, and a front sidewall of a stage overhangs over a groove located in the front of the stage.

11. The photomultiplier tube according to claim 1, wherein widths of the raised parts are narrower than widths of the stages of the electron multiplying part in the direction measured from the first end to the second end, such that a front and a rear sidewall of a stage overhangs the corresponding raised part.

* * * * *